US006897830B2

(12) United States Patent
Bae et al.

(10) Patent No.: US 6,897,830 B2
(45) Date of Patent: May 24, 2005

(54) MULTI-BAND HELICAL ANTENNA

(75) Inventors: Jung Bin Bae, Gwangju (KR); Jong Kyu Kim, Gyeonggi-do (KR); Jae Gun Lee, Gyeonggi-do (KR)

(73) Assignee: Antenna Tech, Inc., Gwangju (KR)

( * ) Notice: Subject to any disclaimer, the term of this patent is extended or adjusted under 35 U.S.C. 154(b) by 63 days.

(21) Appl. No.: 10/612,093

(22) Filed: Jul. 3, 2003

(65) Prior Publication Data

US 2004/0095289 A1 May 20, 2004

(30) Foreign Application Priority Data

Jul. 4, 2002 (KR) ..... 10-2002-0038612
Jul. 4, 2002 (KR) ..... 10-2002-0038613
Jul. 4, 2002 (KR) ..... 10-2002-0038611

(51) Int. Cl.[7] ..... H01Q 1/36
(52) U.S. Cl. ..... 343/895
(58) Field of Search ..... 343/700 MS, 867, 343/744, 895

(56) References Cited

U.S. PATENT DOCUMENTS 6,163,307 A * 12/2000 Kim et al. ..... 343/895
6,333,722 B1 * 12/2001 Kitano ..... 343/895
6,369,777 B1 * 4/2002 Ohara et al. ..... 343/895
6,421,015 B1 * 7/2002 Chen ..... 343/700 MS
6,448,934 B1 * 9/2002 Lee et al. ..... 343/702
6,501,438 B2 * 12/2002 Nevermann et al. ..... 343/895
6,583,769 B2 * 6/2003 Shiroki et al. ..... 343/895
6,680,713 B2 * 1/2004 Yokoshima et al. ..... 343/895

* cited by examiner

*Primary Examiner*—Tan Ho
(74) *Attorney, Agent, or Firm*—McGuireWoods LLP

(57) ABSTRACT

A multi-band helical antenna of the present invention includes a dielectric body including a plurality of dielectric sheets stacked in a predetermined order and a first and a second metallic pattern sections provided in the dielectric body. The first metallic pattern includes a plurality of first partially opened metallic loop patterns and a plurality of first connection elements connecting the respective adjacent first partially opened metallic loop patterns to form a first spiral structure. The second metallic pattern section includes a plurality of second partially opened metallic loop patterns and a plurality of second connection elements connecting the respective adjacent second partially opened metallic loop patterns to form a second spiral structure. The first and the second metallic pattern sections having different entire lengths. Accordingly, the multi-band helical antenna of the present invention has a dual resonant frequency characteristic and operates in different frequency bands.

18 Claims, 20 Drawing Sheets

MULTI-BAND HELICAL ANTENNA

FIELD OF THE INVENTION

The present invention relates to an antenna for a mobile communications or radio communications terminal transmitting and receiving a radio frequency signal; and, more particularly, to a multi-band helical antenna capable of operating in multiple frequency bands by varying impedances thereof.

BACKGROUND OF THE INVENTION

Recently, various mobile communications systems such as a cellular service system, PCS system, GMS system and Iridium service system using a satellite are available throughout the world. For example, in Korea, cellular service, PCS and CT-2 systems are commercially provided. Portable terminals used in the mobile communications systems have been developed and pushed for improvement in compactness, multifunction, lightweight and low power-consumption. An antenna functions to transmit and receive a signal between a terminal and a base station, and is a critical component determining communication quality of the terminal. Since performance of the antenna may vary depending on the shape and material of the terminal where the antenna is mounted, the antenna should be designed compatible with a model of the terminal in order to obtain an optimal performance thereof.

In general, for the purpose of bidirectional communications and convenient possession, a non-directional retractable antenna is used as an antenna for a terminal. An antenna of a commercially available terminal has a combined structure suitable for both a signal waiting state and a communications state to transmit and receive a linearly polarized signal with ease. There are largely two kinds of antennas, i.e., a helical antenna and a monopole antenna.

The helical antenna has a spiral configuration which protrudes from a top of the terminal and has an advantage in that it can communicate regardless of the orientation of the terminal.

The monopole antenna is used in an extended state for a high quality communication. The monopole antenna has a greater ability in a vertical orientation than the helical antenna, but theoretically cannot receive a signal in a horizontal orientation.

The performance of such an antenna depends on the shapes of the terminals on which it is mounted and a matching circuit is provided between the antenna and a duplex in order to compensate the difference in performance.

The helical antenna has a spiral structure with a physical resonant length of $\lambda/2$ and $\lambda/4$ which uses a connection element. The helical antenna also has a ground surface and an electric power supplying line.

In particular, a conventional helical antenna is a single band helical antenna implemented by using ceramic sheets of thickness of tens or hundreds of micrometer and forming a vertical via hole and a horizontal pattern in each of the sheets. The implemented antenna structurally exhibits a single band characteristic, and is therefore unable to operate in two or more different bands.

Specifically, the cellular service system and the PCS system use, e.g., 824~894 MHz band and 1750~1870 MHz band, respectively, with the center frequencies thereof spaced apart from each other by about 1 GHz, and the center frequencies are not in an integer time relationship with harmonics component thereof. Accordingly, the conventional antenna cannot be used in both the cellular service system and the PCS system using different frequency bands even though a matching circuit is employed thereto.

Attempts have been made to allow one terminal to operate in various communications systems using different frequency bands so that the terminal can be used throughout the world. In this case, the antenna and other components employed in such terminal for various communications systems should meet an electrical standard and operate in two or more frequency bands. The antenna should also be able to operate in next-generation mobile communications services such as IMT-2000 with a broader frequency band and in two or more different mobile communications service bands.

SUMMARY OF THE INVENTION

It is, therefore, a primary object of the present invention to provide a multi-band helical antenna capable of operating in multiple frequency bands.

In accordance with an aspect of the present invention, there is provided a multi-band helical antenna comprising: a dielectric body including a plurality of dielectric sheets stacked in a predetermined order; and at least a first metallic pattern section and a second metallic pattern section provided in the dielectric body, the first metallic pattern including a plurality of first partially opened metallic loop patterns and a plurality of first connection elements connecting the respective adjacent first partially opened metallic loop patterns to form a first spiral structure, and the second metallic pattern section including a plurality of second partially opened metallic loop patterns and a plurality of second connection elements connecting the respective adjacent second partially opened metallic loop patterns to form a second spiral structure, the first and the second metallic pattern section having different entire lengths.

In accordance with another aspect of the present invention, there is provided a multi-band helical antenna comprising: a dielectric body including at least a plurality of first dielectric sheets of a first thickness t1 and a plurality of second dielectric sheets of a second thickness t2 that is different from t1, the dielectric sheets being stacked in a predetermined order; and at least a first metallic pattern section and a second metallic pattern section provided in the first dielectric sheets and the second dielectric sheets, respectively, the first metallic pattern section including a plurality of first partially opened metallic loop patterns spaced apart from each other by a first distance and a plurality of first connection elements connecting the respective adjacent first metallic loop patterns to form a first spiral structure, and the second metallic pattern section including a plurality of second partially opened metallic loop patterns spaced apart from each other by a second distance and a plurality of second connection elements connecting the respective adjacent second metallic loop patterns to form a first spiral structure.

In accordance with still another aspect of the present invention, there is provided a multi-band helical antenna comprising: a dielectric body including a plurality of dielectric sheets of a predetermined thickness, the dielectric sheets being stacked in a predetermined order; and at least a first metallic pattern section and a second metallic pattern section provided in the dielectric body, the first metallic pattern section including a plurality of first partially opened metallic loop patterns having a first radius r1 and a plurality of first connection elements connecting the respective adjacent first partially opened metallic loop patterns to form a first spiral structure, and the second metallic pattern section including a plurality of second partially opened metallic loop patterns having a second radius r2 that is different from r1 and a plurality of second connection elements connecting the respective adjacent second partially opened metallic loop patterns to form a second spiral structure.

In accordance with still another aspect of the present invention, there is provided a multi-band helical antenna comprising: a dielectric body including a plurality of dielectric sheets of a predetermined thickness, the dielectric sheets being stacked in a predetermined order; at least a first metallic pattern section and a second metallic pattern section provided in the dielectric body, the first metallic pattern section including a plurality of first partially opened metallic loop patterns having a first entire length l1 and a plurality of first connection elements connecting the respective adjacent first partially opened metallic loop patterns to form a first spiral structure, and the second metallic pattern section including a plurality of second partially opened metallic loop patterns having a second entire length l2 different from l1 and a plurality of second connection elements connecting the respective adjacent second partially opened metallic loop patterns to form a second spiral structure.

BRIEF DESCRIPTION OF THE DRAWINGS

The above and other objects and features of the present invention will become apparent from the following description of preferred embodiments given in conjunction with the accompanying drawings in which.

DETAILED DESCRIPTION OF THE PREFERRED EMBODIMENTS

Preferred embodiments of the present invention will now be described in detail with reference to the accompanying drawings.

Figure 1:
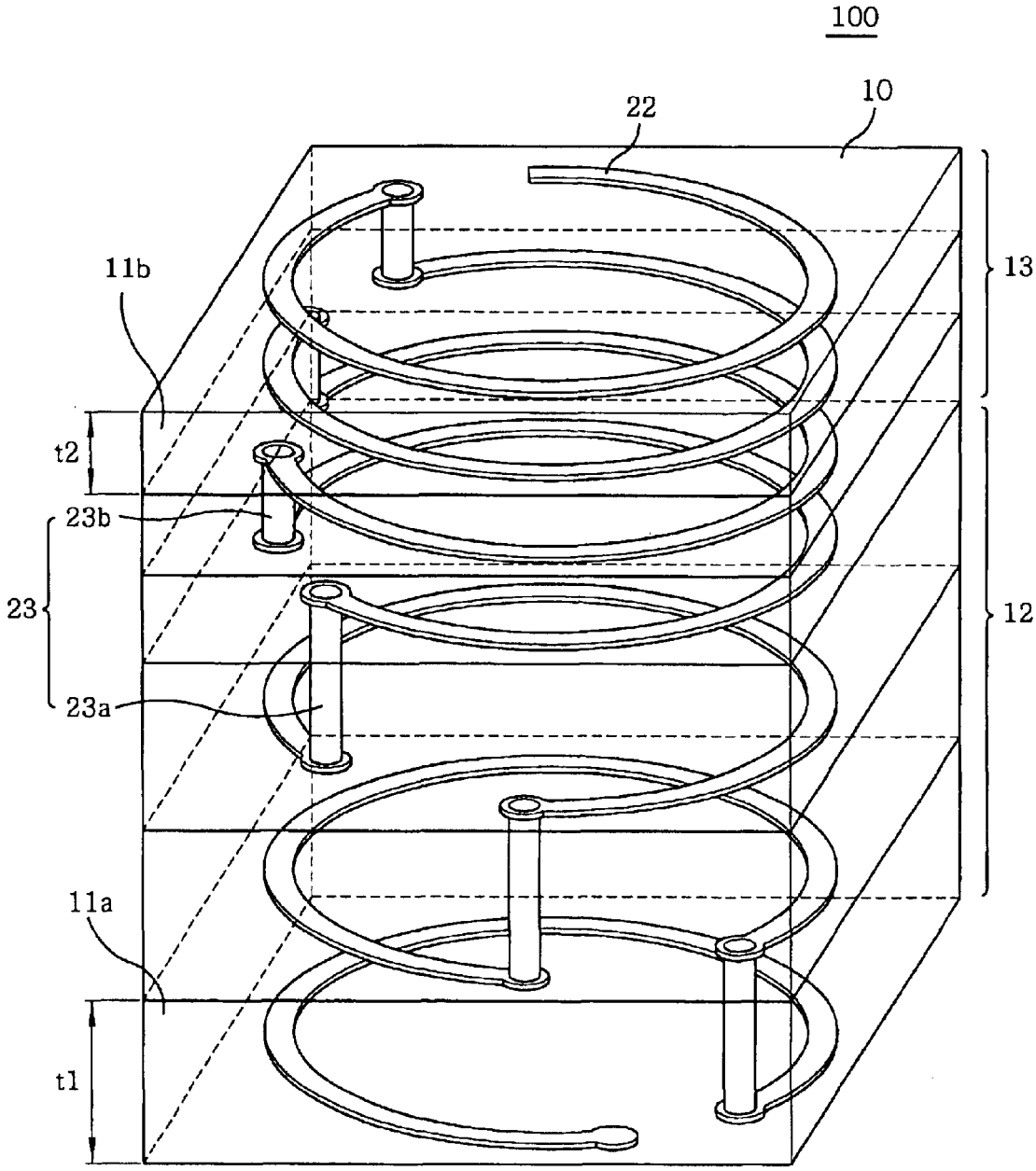
FIG. 1 is a perspective view showing a multi-band helical antenna in accordance with a first embodiment of the present invention.
Figure 2:
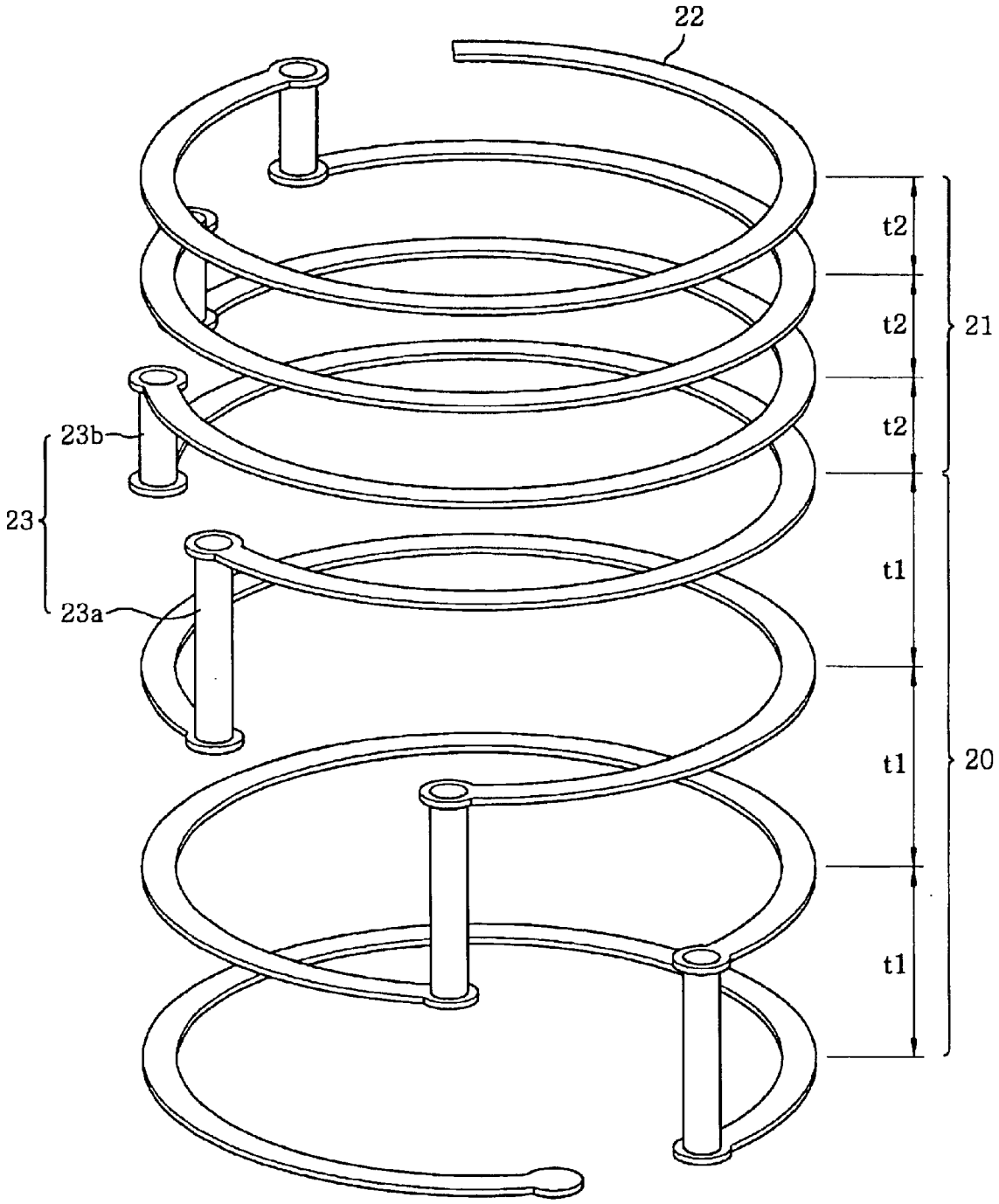
FIG. 2 is a perspective view showing metallic patterns of the multi-band helical antenna in accordance with the first embodiment of the present invention.
Figure 3:
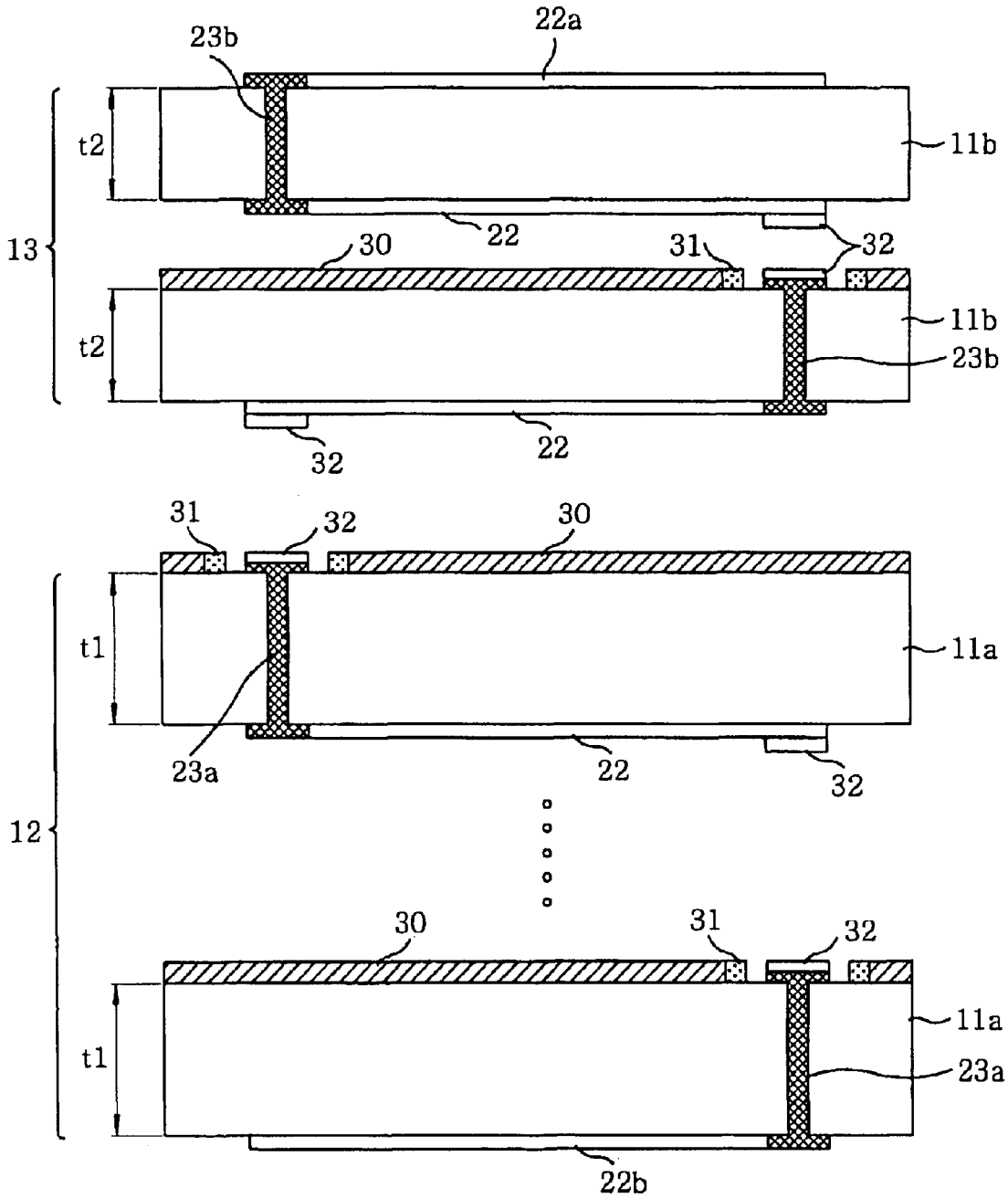
FIG. 3 is an exploded cross-sectional view of the stacked structure of the multi-band helical antenna.
Figure 4A:
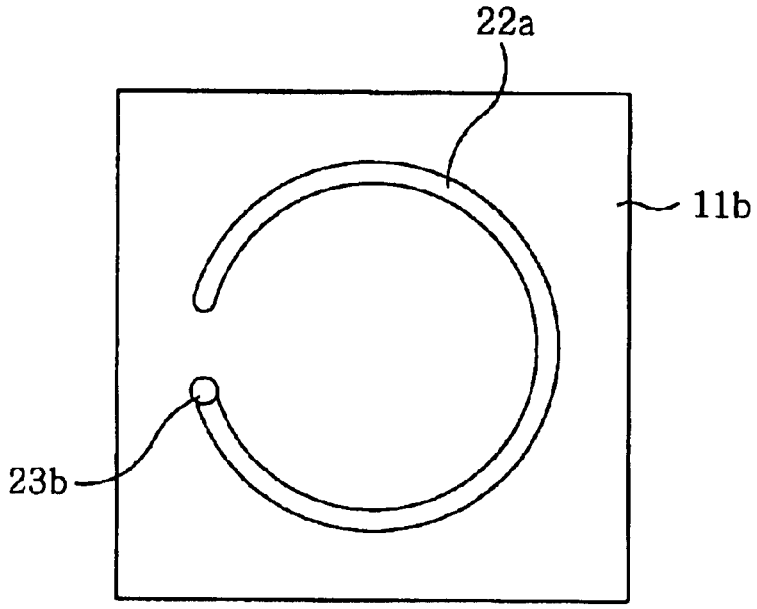
FIGS. 4A and 4B are a top and a bottom views of the uppermost layer of dielectric sheet, respectively.
Figure 4B:
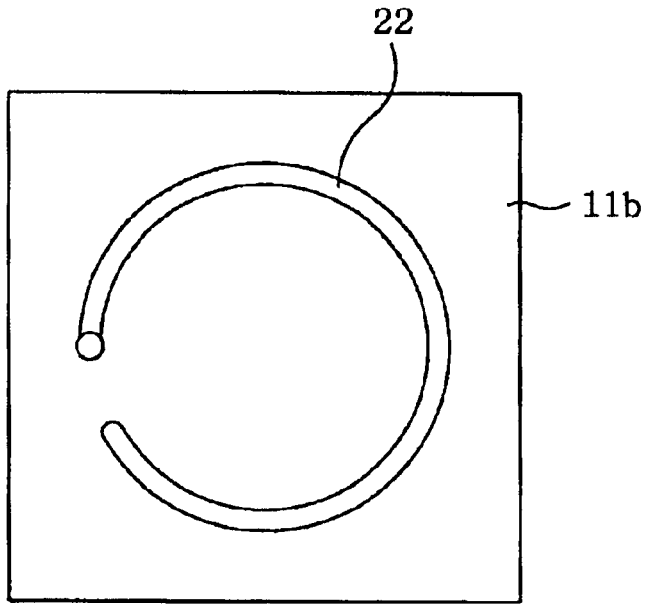
Figure 5A:
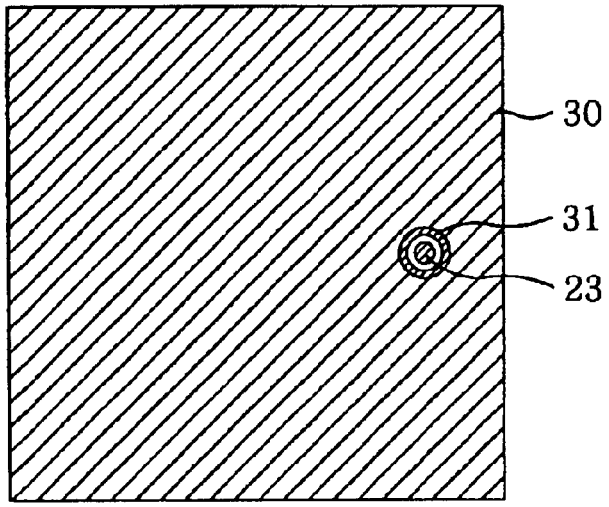
FIGS. 5A and 5B are a top and a bottom views of the intermediate or lower layers of dielectric sheet, respectively.
Figure 5B:
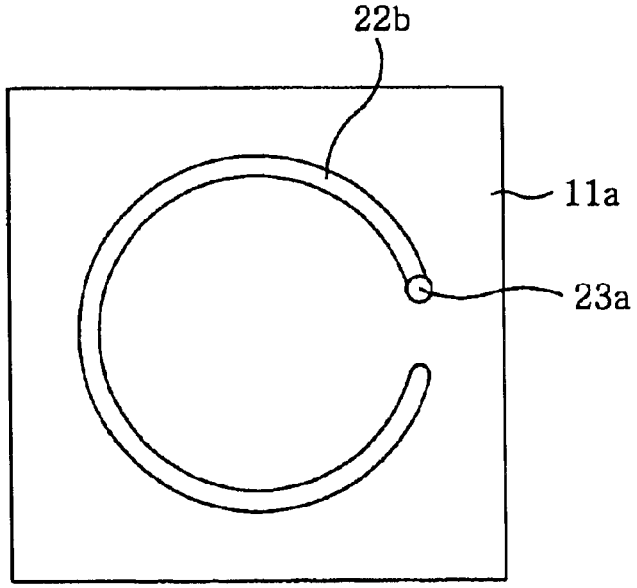
Figure 6:
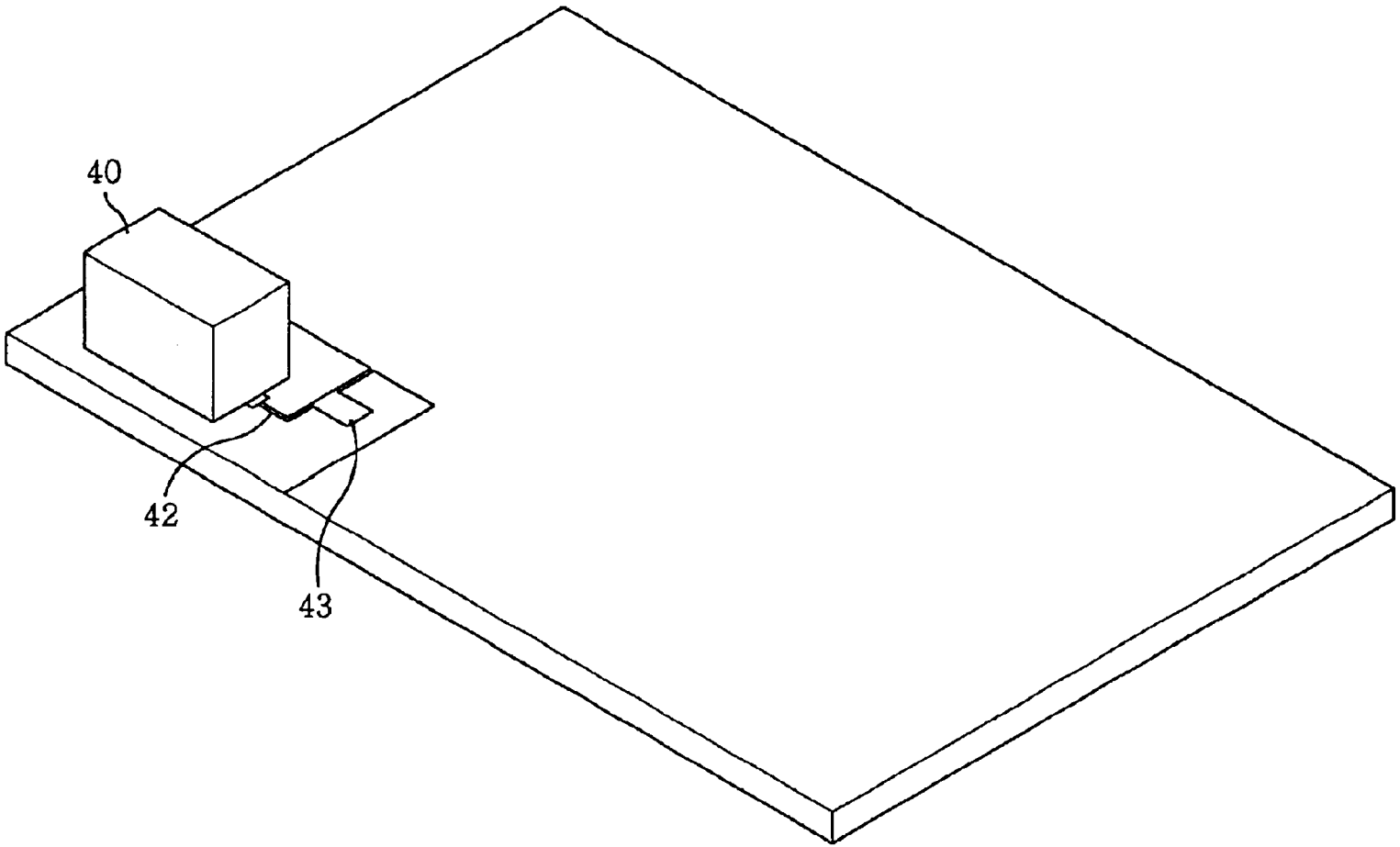
FIG. 6 is a perspective view showing a state in which the multi-band helical antenna in accordance with the present invention is mounted on a top of a terminal.

FIG. 1 is a perspective view showing a multi-band helical antenna in accordance with a first embodiment of the present invention, FIG. 2 is a perspective view showing metallic patterns of the multi-band helical antenna in accordance with the first embodiment of the present invention, FIG. 3 is an exploded cross-sectional view of a stacked structure of the multi-band helical antenna, and FIGS. 4A and 4B are a top and a bottom views of an uppermost layer of dielectric sheet, respectively. FIGS. 5A and 5B are a top and a bottom views of an intermediate or a lower layers of dielectric sheet, respectively, and FIG. 6 is a perspective view showing a state in which the multi-band helical antenna in accordance with the present invention is mounted on a top of a terminal.

Referring to FIGS. 1 and 2, the multi-band helical antenna of the present invention comprises a dielectric body 10 including a rectangular parallelepiped shape, and metallic pattern sections 20, 21 including a plurality of partially opened circular metallic loop patterns 22 and metallic connection elements 23 which perform helical antenna function.

The dielectric body 10 is constructed by stacking a plurality of dielectric sheets 11*a* of a first thickness t1 and a plurality of dielectric sheets 11*b* of a second thickness t2. Each of the metallic loop patterns 22 of the metallic pattern sections 20, 21 has an opening angle and each of the metallic connection elements 23 connects the adjacent metallic loop patterns 22 to form a spiral structure.

Since the length of the connection elements 23 in the metallic pattern section 20 is different from that in the metallic pattern section 21, the distance between the adjacent loop patterns 22 in the metallic pattern section 20 is different from that in the section 21, thereby allowing the helical antenna to have a dual band resonant characteristic.

In the multi-band helical antenna in accordance with the first preferred embodiment of the present invention, the first metallic pattern section 20 has the loop patterns 22 spaced apart from each other by a distance t1 and the second metallic pattern section 21 has the loop patterns 22 spaced apart from each other by a distance t2; therefore, the helical antenna has a dual resonant characteristic. The distances between the adjacent loop patterns 22 in the first and the second metallic pattern sections 20, 21 are determined by the thicknesses t1, t2 of the dielectric sheets 11*a*, 11*b* or the lengths t1, t2 of the first and the second connection elements 23*a*, 23*b*.

In the above embodiment, for simplification of explanation, two metallic pattern sections having the distances t1, t2 between the loop patterns 22, respectively, are shown; but the present invention is not limited thereto. It is appreciated that the helical antenna may have a multiple resonant characteristic by employing three or more pattern sections having different loop pattern distances.

Typically, the entire height of the dielectric body 10 of the helical antenna can be varied in accordance with the frequency being used, the length of metallic patterns, and the length of connection elements; and when used as a mobile communications antenna, the dielectric body 10 has a height of about 5~15 mm.

For example, for use in a band of 1.8 GHz, the helical antenna has two and a half turns of metallic patterns; and for use in a band of 1.2 GHz, the helical antenna has four turns of metallic patterns. The distances between the metallic patterns range approximately 0.6~3.2 mm. The multiple resonant characteristic is obtained by changing electrical impedance in an equivalent circuit of the helical antenna depending on the distance variations of the metallic patterns. The radiational and directional characteristics of the helical antenna in accordance with the present invention are the same as those of the conventional helical antenna, and the detailed descriptions thereon are omitted accordingly.

Referring to FIGS. 3A to 5B, the stacking process of the helical antenna in accordance with the present invention will now be described.

The plurality of first dielectric sheets 11*a* of a thickness t1 and the plurality of second dielectric sheets 11*b* of a thickness t2 are prepared. The partially opened circular loop pattern 22 is formed on bottom surfaces of the first and the second dielectric sheets 11*a*, 11*b* to form the first and the second metallic pattern sections 20, 21, respectively. An uppermost dielectric sheet has the partially opened circular loop pattern 22 on the top surface thereof.

The first and second connection elements 23*a*, 23*b* are formed by forming a via hole in each of the dielectric sheets 11*a*, 11*b* and filling the via hole with a conductive metallic material same as that of the loop patterns 22. Specifically, the first connection elements 23*a* of length t1 extend through the dielectric sheets 11*a* in a first dielectric portion 12, and the second connection elements 23*b* of length t2 extend through the dielectric sheets 11*b* in a second dielectric portion 13. The via hole is located such that an end portion of the loop pattern 22 is connected to the corresponding connection element 23*a* or 23*b* filled therein.

With the exception of the uppermost dielectric sheet 11*b*, an adhesive layer 30 is applied on the top surfaces of the dielectric sheets 11*a*, 11*b* for the stack thereof. The adhesive layer 30 disposed on the electrical contact portion of the connection element 23 is removed by, e.g., masking. Preferably, a barrier 31 is disposed around the connection element 23 for preventing the adhesive material from contacting the connection element 23. Preferably, the barrier 31 has a circular shape and a height of about 0.5~1.5 mm to shield the connection element 23.

One dielectric sheet 11*a* or 11*b* is stacked on a top surface of another dielectric sheet 11*b* on which the adhesive layer 30 is applied such that an upper end of the connection element 23 is connected with a starting end portion of the partially opened circular loop pattern 22. Preferably, a contact material 32 is coated on one or both of the contact portions of the connection element 23 and the loop pattern 22 in order to facilitate an electrical connection therebetween. The contact material 32 may be a good conductive metal such as copper, silver and gold.

The starting end portion of the partially opened loop pattern 22*b* formed on the bottom surface of a lowermost dielectric sheet 11*a* is electrically connected to a line 42 for supplying an electric power to the antenna and connected to a matching circuit 43 for matching the antenna. (see FIG. 6)

FIG. 6 shows a state in which the multi-band helical antenna of the present invention is mounted on a top of a terminal. The line 42 for supplying the electric power to the multi-band helical antenna and the matching circuit 43 for matching the antenna are electrically connected to the helical antenna.

Figure 7:
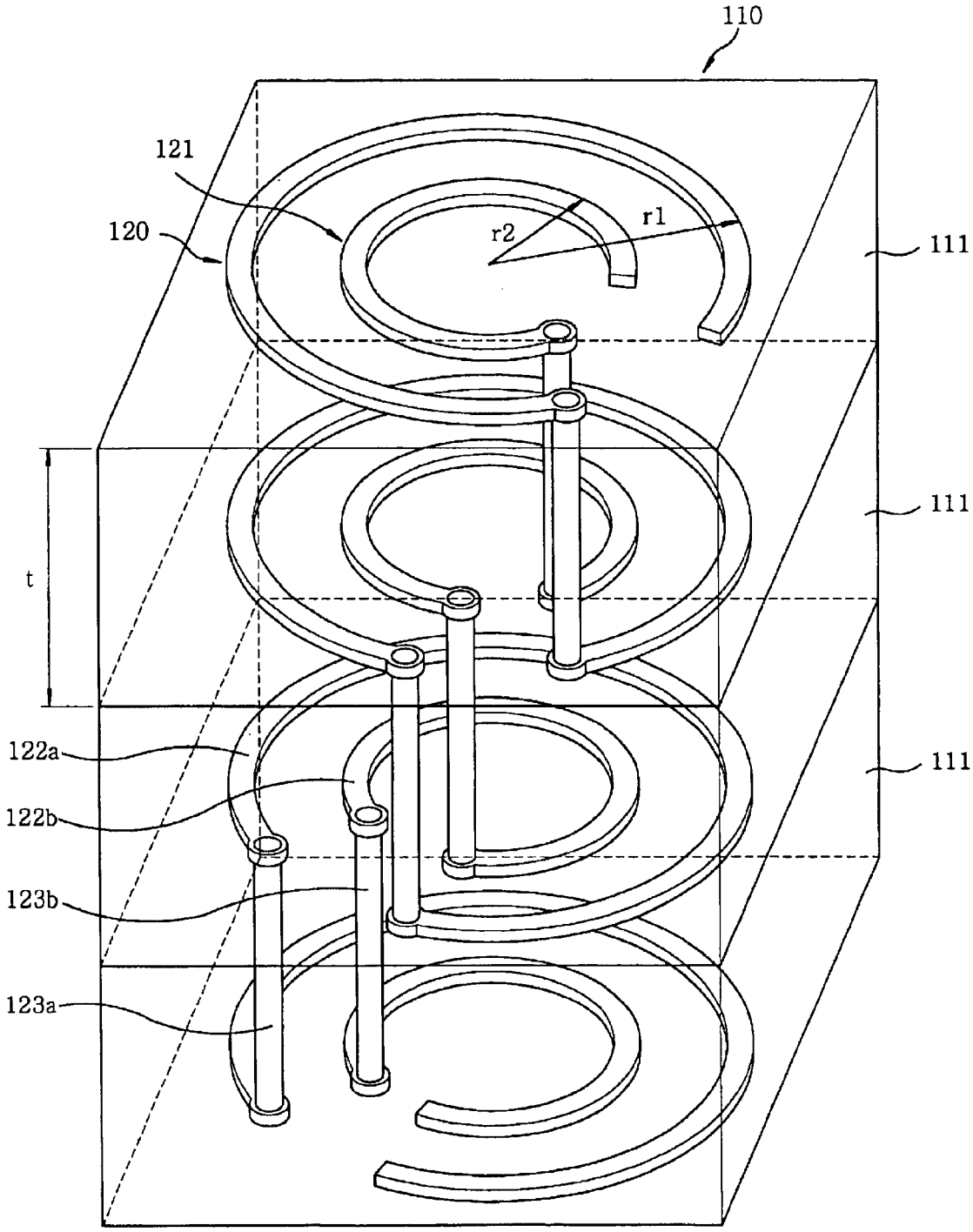
FIG. 7 is a perspective view showing a multi-band helical antenna in accordance with a second preferred embodiment of the present invention.
Figure 8:
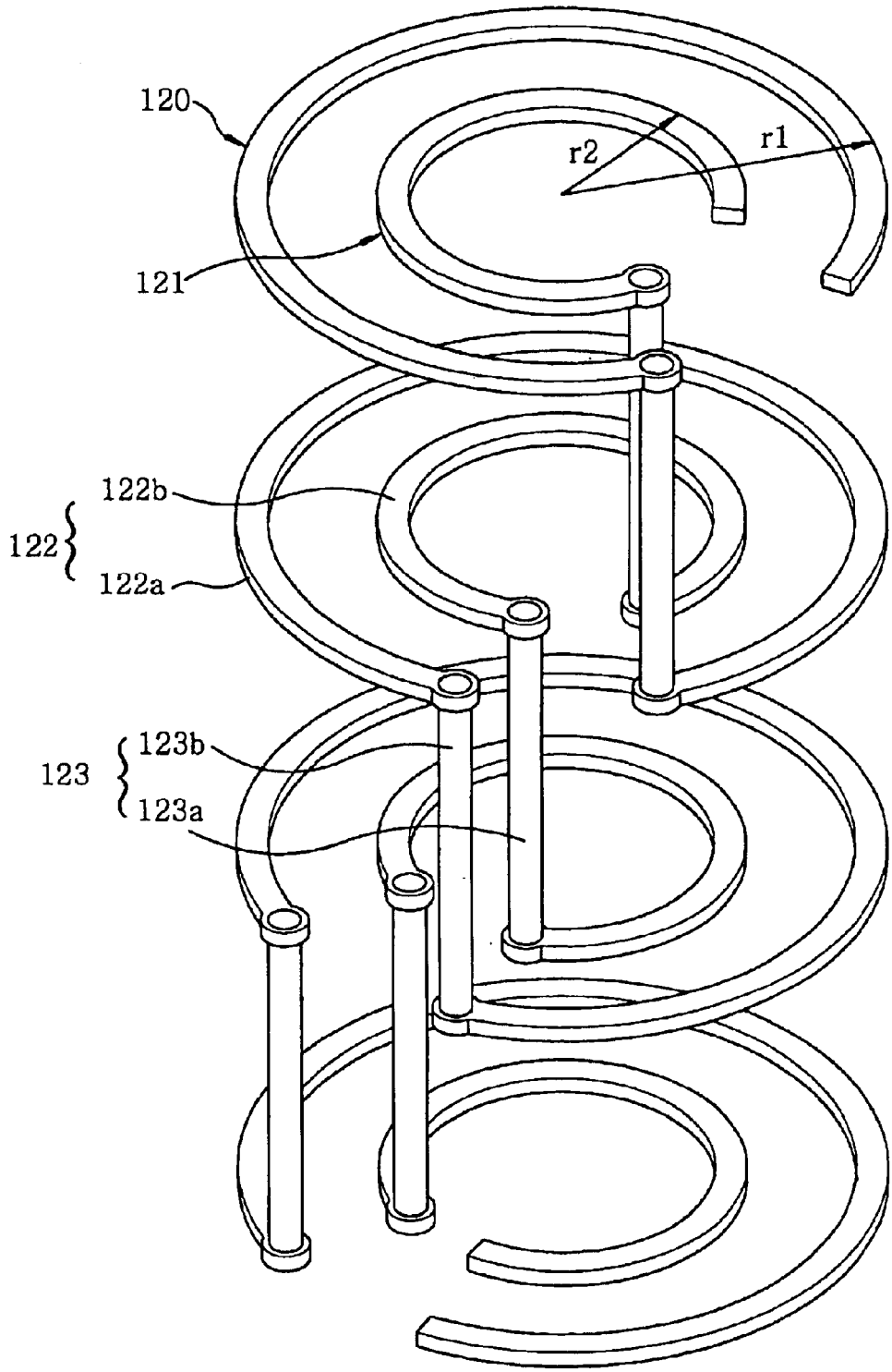
FIG. 8 is a perspective view showing metallic patterns of the multi-band helical antenna in accordance with the second preferred embodiment of the present invention.

FIG. 7 is a perspective view showing a multi-band helical antenna in accordance with a second preferred embodiment of the present invention, and FIG. 8 is a perspective view showing metallic patterns of the multi-band helical antenna in accordance with the second preferred embodiment of the present invention.

Referring to FIG. 7, the multi-band helical antenna in accordance with the second embodiment of the present invention includes a dielectric body 110 having a rectangular parallelepiped shape, and a first and a second metallic pattern sections 120, 121 comprising a plurality of first and second partially opened circular metallic loop patterns 122*a*, 122*b* and a plurality of first and second metallic connection elements 123*a*, 123*b*, respectively, which perform helical antenna function.

The dielectric body 110 is constructed by stacking a plurality of dielectric sheets 111 of a predetermined thickness t. The first and the second partially opened circular metallic loop patterns 122*a* and 122*b* have radii r1 and r2 different from each other, respectively. The connection elements 123*a* connect the adjacent loop patterns 122*a* and the connection elements 123*b* connect the adjacent loop patterns 123*b*. In this way, the helical antenna has a dual band resonant characteristic.

As shown in FIG. 8, in the helical antenna in accordance with the second preferred embodiment of the present invention, the first metallic pattern section 120 has the first loop patterns 122*a* of a first radius r1 and the second metallic pattern section 121 has the second loop patterns 122*b* of a second radius r2 smaller than r1. The first and the second metallic pattern sections 120 are separated from each other so that the helical antenna has a dual resonant characteristic.

In the above embodiment, for simplification of explanation, two metallic pattern sections having the radii r1, r2, respectively, are shown, but the present invention is not limited thereto. It is appreciated that the helical antenna may have a multiple resonant characteristic by employing three or more pattern sections having different loop pattern radii.

The multiple resonant characteristic is obtained by changing electrical impedance in an equivalent circuit of the helical antenna depending on the radius variations of the metallic patterns. The radiational and directional characteristics of the helical antenna in accordance with the second preferred embodiment of the present invention are the same as those of the conventional helical antenna, and the detailed descriptions thereon are omitted accordingly.

Referring to FIGS. 9A to 11B, the stacking process of the helical antenna in accordance with the second preferred embodiment of the present invention will now be described.

Figure 9A:
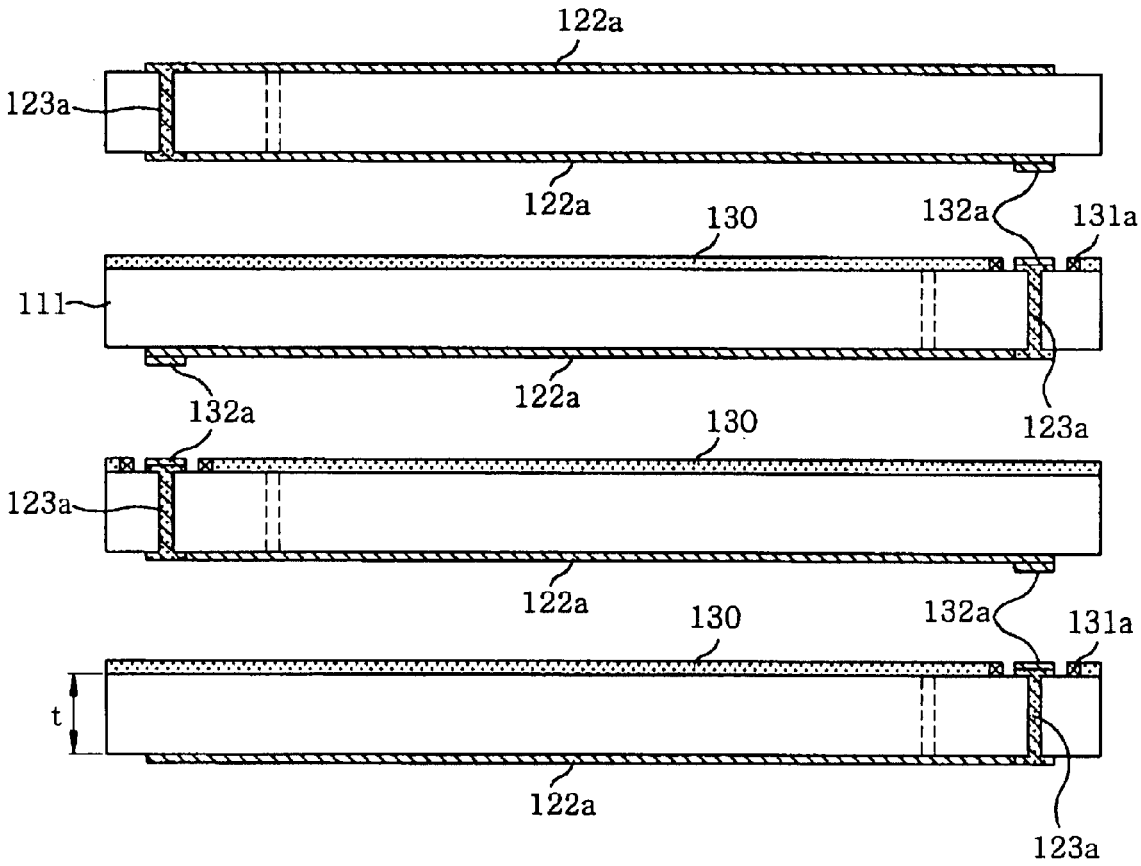
FIGS. 9A and 9B are exploded cross-sectional views of the first metallic section 120 and the second metallic section 121, respectively.
Figure 9B:
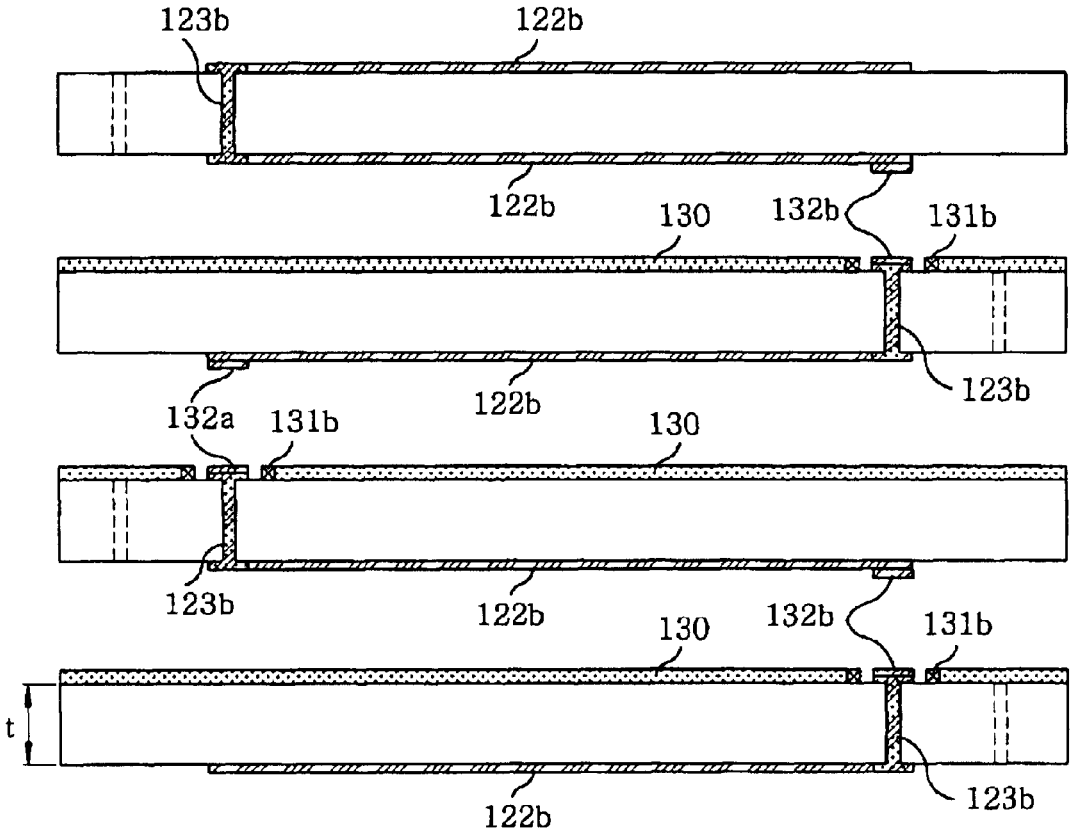

FIG. 9A is an exploded cross-sectional view of the first metallic section 120 and FIG. 9B is an exploded cross-sectional view of the second metallic section 121. They are separately shown for easy understanding thereof.

Figure 10A:
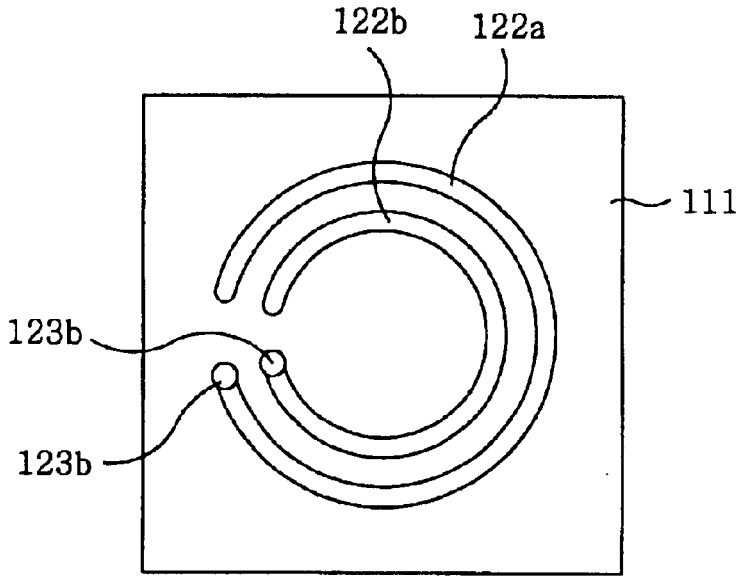
FIGS. 10A and 10B are a top and a bottom views of the uppermost layer of dielectric sheet, respectively.
Figure 10B:
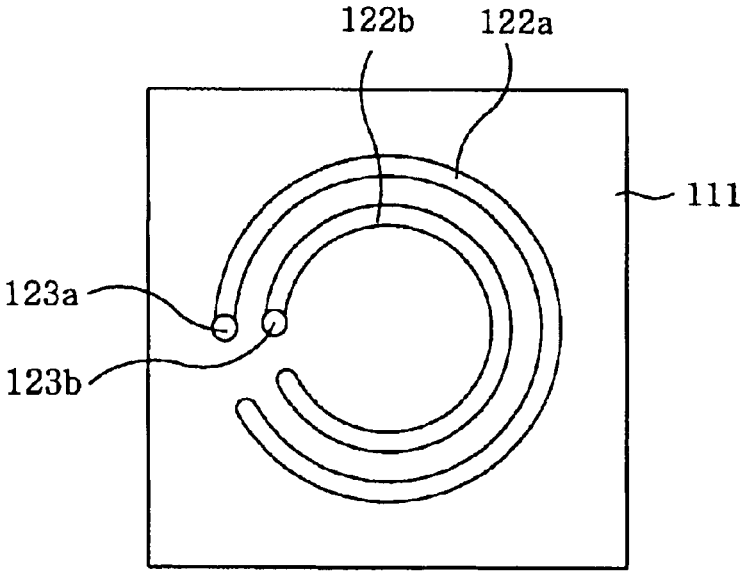
Figure 11A:
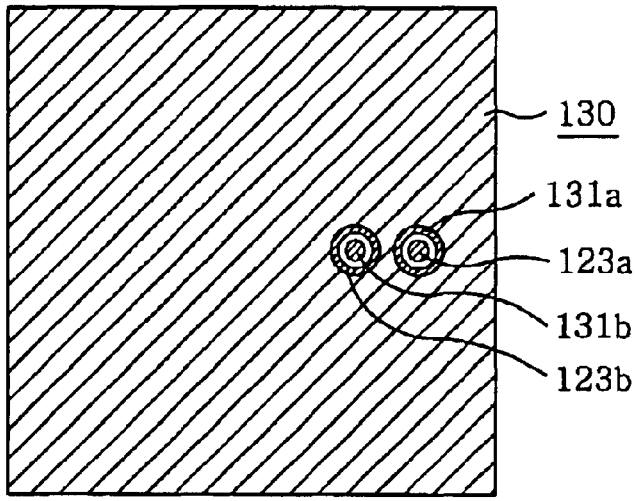
FIGS. 11A and 11B are a top and a bottom views of one of the intermediate or lower dielectric sheets, respectively.
Figure 11B:
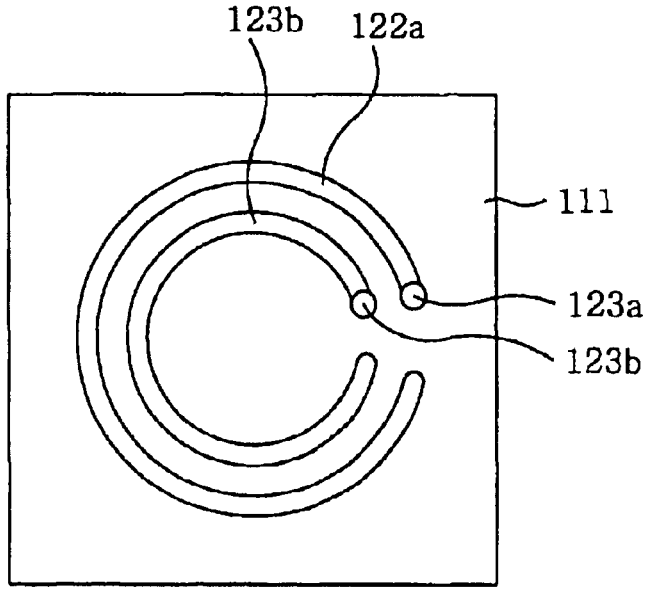

FIGS. 10A and 10B are a top and a bottom views of the uppermost layer of dielectric sheet, respectively, and FIGS.

11A and 11B are a top and a bottom views of one of the intermediate or lower dielectric sheets, respectively.

The plurality of dielectric sheets 111 of a predetermined thickness t is prepared. The first and the second partially opened circular loop patterns 122*a*, 122*b*, which have different radii from each other, are formed on the bottom surface of each of the dielectric sheets 111.

Next, the first and second connection elements 123*a*, 123*b* are formed by forming at one end portion of each of the first and the second loop patterns 122*a*, 122*b* a via hole extending through the dielectric sheets 111 and filing the via hole with a conductive metallic material same as that of the loop patterns 122*a*, 122*b*. In this way, the first metallic section 120 comprises the loop patterns 122*a* of radius r1 and the first connection elements 123*a*, and the second metallic section 121 comprises the loop patterns 122*b* of radius r2 and the second connection elements 123*b*. The connection elements 123*a*, 123*b* connect adjacent loop patterns 122*a*, 122*b*, respectively.

The uppermost dielectric sheet 111 has the first and the second loop patterns 122*a*, 122*b* on the top surface as well as the bottom surface thereof. Further, with the exception of the uppermost dielectric sheet 111, an adhesive layer 130 is applied on the top surfaces of the dielectric sheets 111 for the stack thereof.

The adhesives 130 disposed on an electrical contact portion of the connection elements 123*a*, 123*b* are removed by, e.g., masking. Preferably, barriers 131*a*, 131*b* are disposed around the connection elements 123*a*, 123*b* for preventing the adhesive material from contacting the connection elements 123*a*, 123*b*. Preferably, the barriers 131 have a circular shape and a height of about 0.5~1.5 mm to shield the connection elements 123*a*, 123*b*.

One dielectric sheet 111 is stacked on the top surface of another dielectric sheet 111 on which the adhesive layer 130 is applied. At this time, the dielectric sheets 111 are arranged in such a way that upper ends of the connection elements 123*a*, 123*b* are connected with starting end portions of the partially opened circular loop patterns 122*a*, 122*b*, respectively. Preferably, a contact material 132 is coated on one or both of contact portions of the respective connection elements 123 and the respective loop patterns 122 in order to facilitate the electrical connection therebetween. The contact material 132 may be a good conductive metal such as copper, silver and gold.

The starting end portions of the partially opened circular loop patterns 122 formed on the bottom surface of the lowermost dielectric sheet 111 are electrically connected to lines for supplying electric power to the antenna and connected to matching circuits 43 for matching the antenna, respectively. (see FIG. 6)

Figure 12:
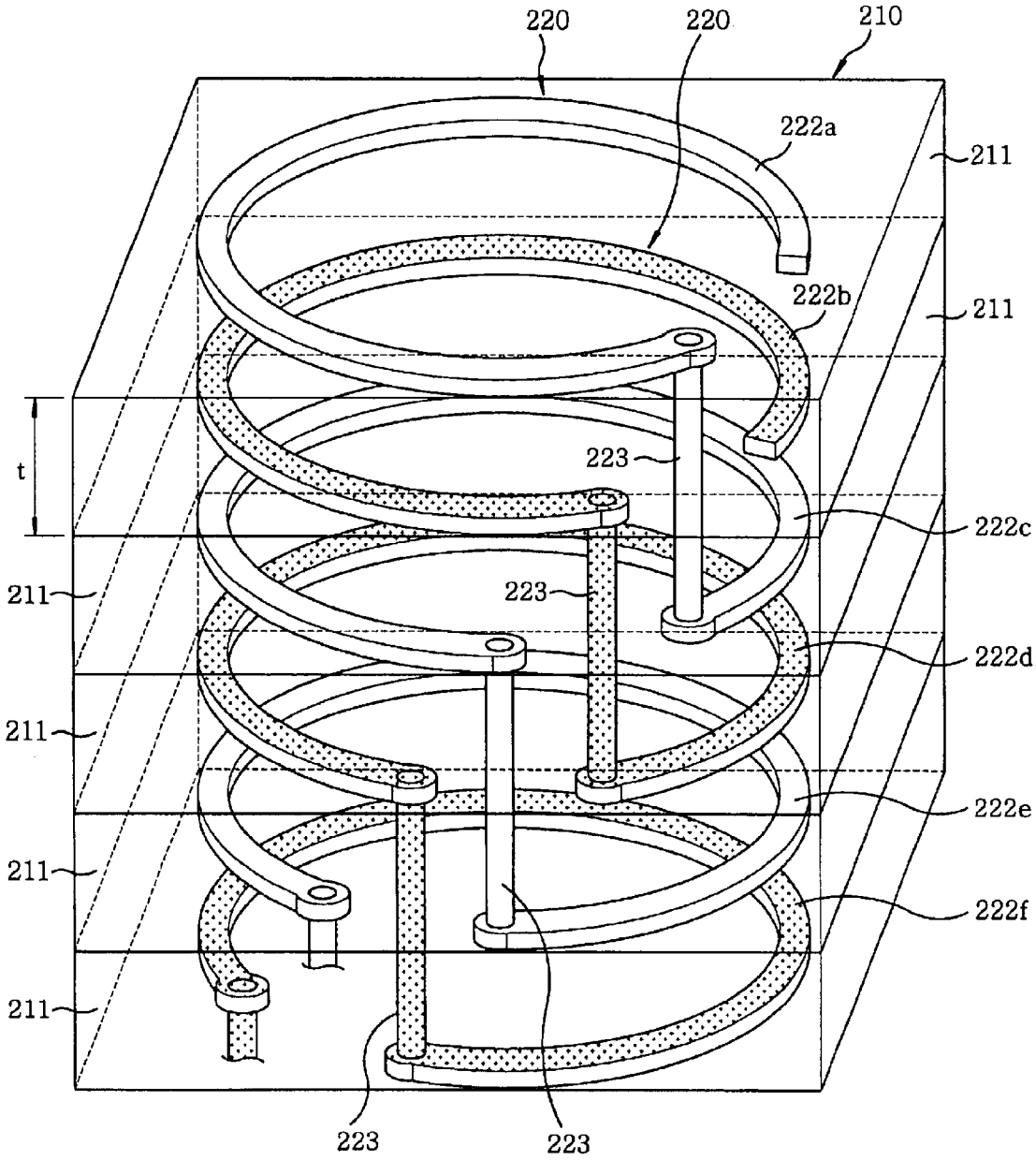
FIG. 12 is a perspective view showing a multi-band helical antenna in accordance with a third embodiment of the present invention.
Figure 13A:
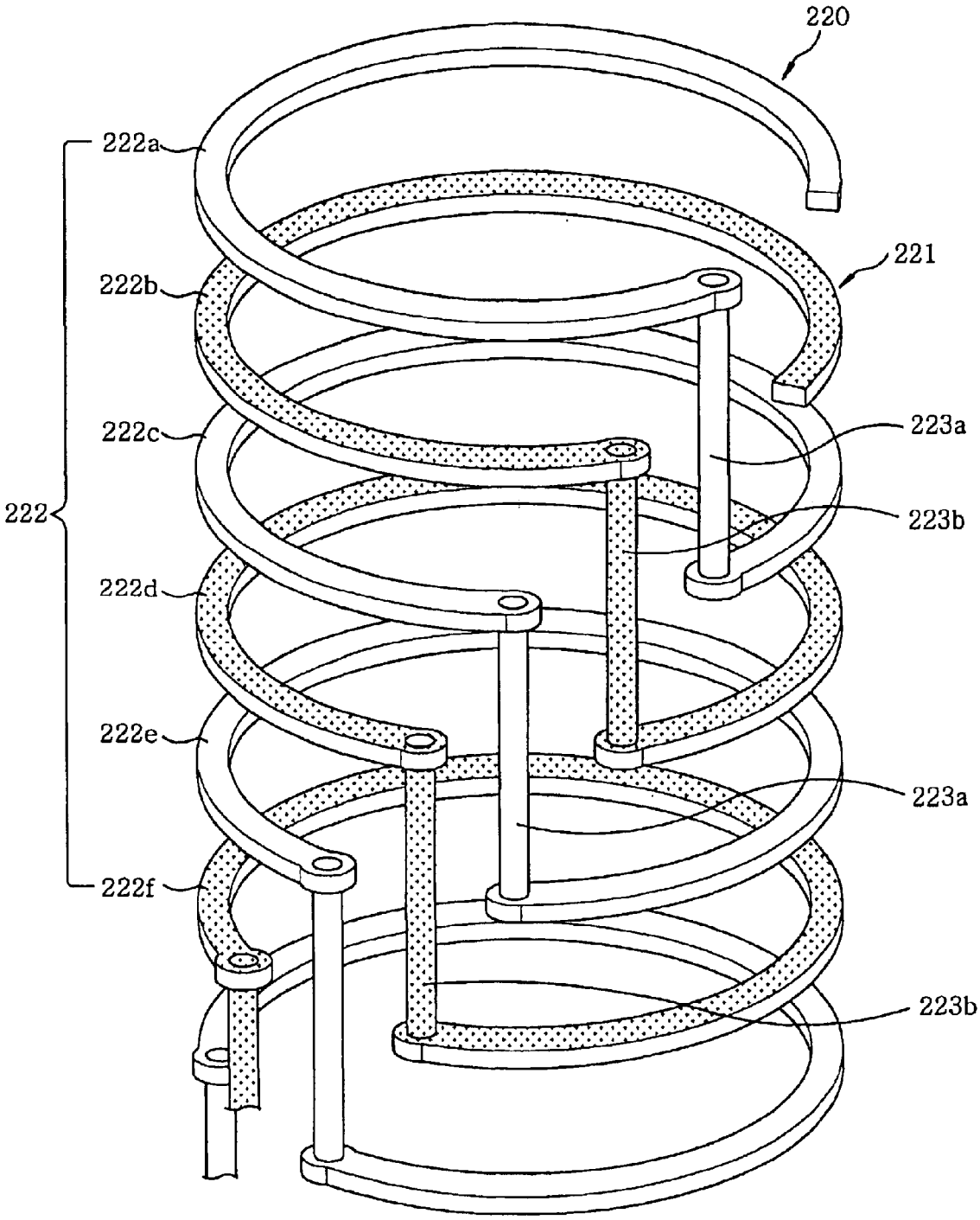
FIGS. 13A and 13B are perspective views showing metallic patterns of the multi-band helical antenna, respectively, in accordance with the third embodiment of the present invention.
Figure 13B:
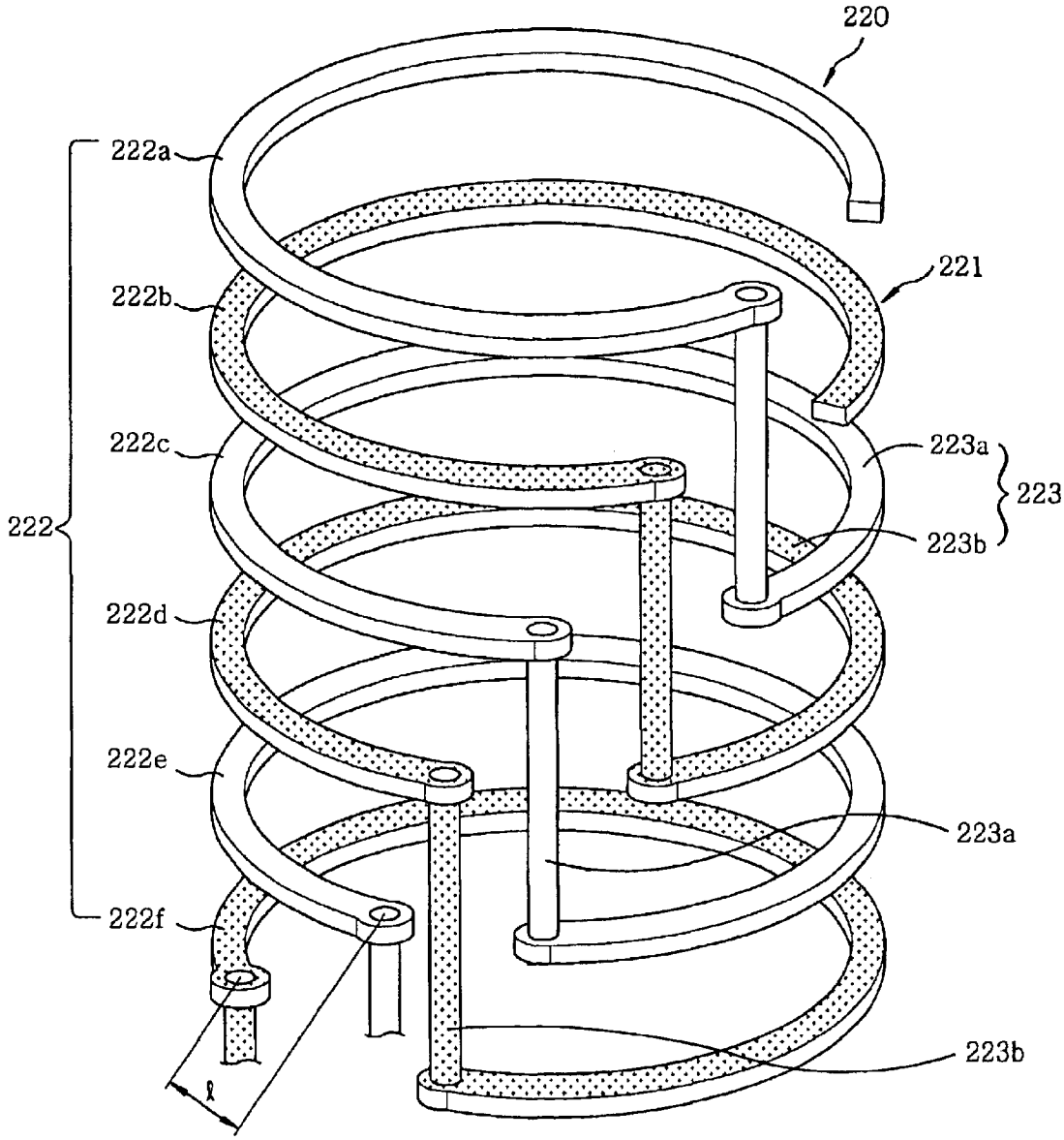

FIG. 12 is a perspective view showing a multi-band helical antenna in accordance with a third embodiment of the present invention, and FIGS. 13A and 13B are perspective views showing metallic patterns of the multi-band helical antenna in accordance with the third embodiment of the present invention, respectively.

Referring to FIGS. 12 to 13B, a multi-band helical antenna in accordance with the third preferred embodiment of the present invention includes a dielectric body 210 of a rectangular parallelepiped shape, and metallic pattern sections 220, 221 comprising a plurality of partially opened circular metallic loop patterns 222 having an opening angle and metallic connection elements 223 which perform helical antenna function.

The dielectric body 210 is constructed by stacking a plurality of dielectric sheets 211 of a predetermined thickness t. The partially opened circular metallic loop patterns 222 of the metallic pattern sections 220, 221 are vertically disposed at regular intervals. The odd numbered loop patterns 222*a*, 222*c*, 222*e* of the first metallic pattern section 220 are in turn connected by connection elements 223*a*, and the even numbered loop patterns 222*b*, 222*d*, 222*f* of the second metallic pattern section 221 are in turn connected by connection elements 223*b*. Particularly, the entire length of the first metallic pattern section 220 is different from that of the second metallic pattern section 221 so that the helical antenna has a wide band characteristic in a single band or a dual band resonant characteristic.

Figure 14:
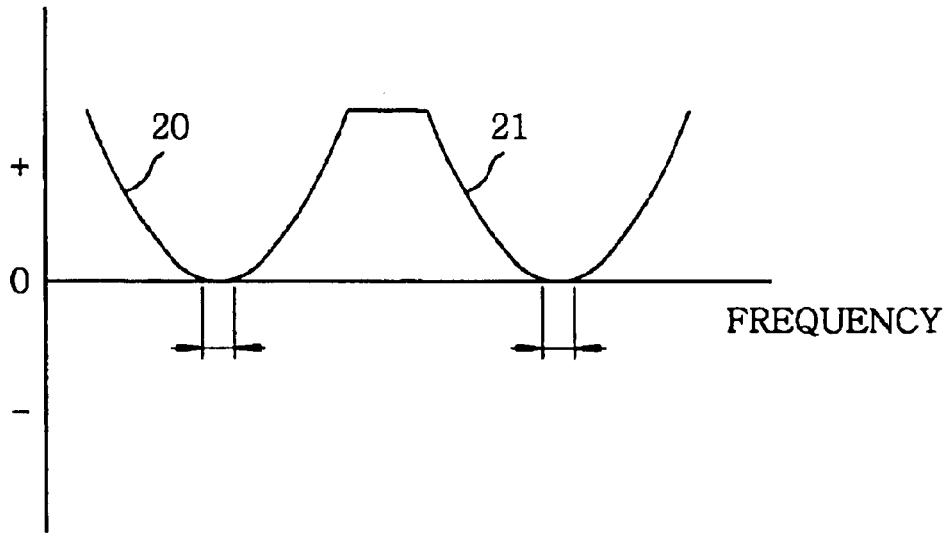
FIG. 14 is a graph showing the dual resonant characteristic of the helical antenna in accordance with the third preferred embodiment of the present invention.

In the helical antenna in accordance with the third embodiment of the present invention, as shown in FIG. 13A, the turns in the first and the second metallic pattern sections 220, 221 are different from each other so that the helical antenna has a dual resonant characteristic and can operate in two different bands. FIG. 14 is a graph showing the dual resonant characteristic of the helical antenna in accordance with the third preferred embodiment of the present invention. Specifically, the resonant frequencies are determined by the resonant lengths of the first metallic pattern section 220 and the second metallic pattern section 221, thereby allowing the helical antenna to operate in dual bands.

Figure 15:
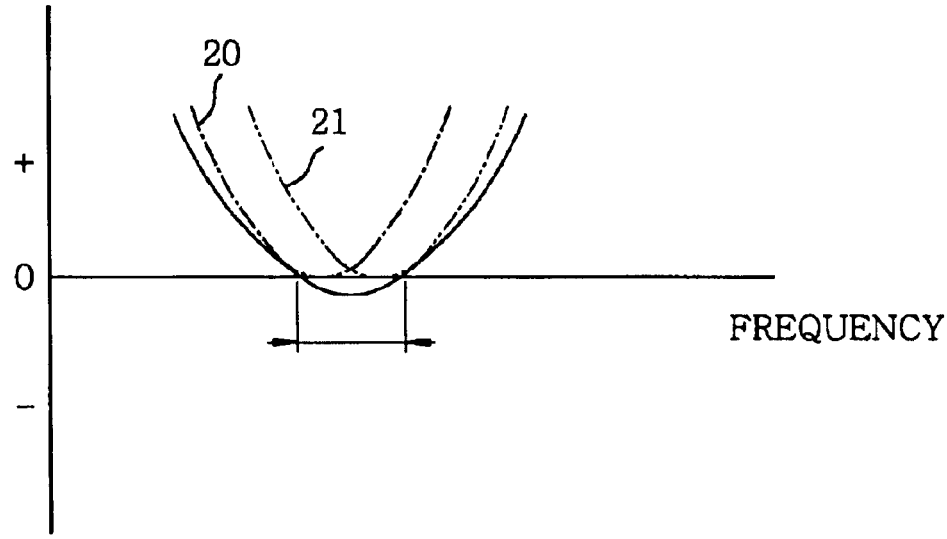
FIG. 15 is a graph showing a resonant characteristic in a wide band in accordance with the variation of the present invention.
Figure 16:
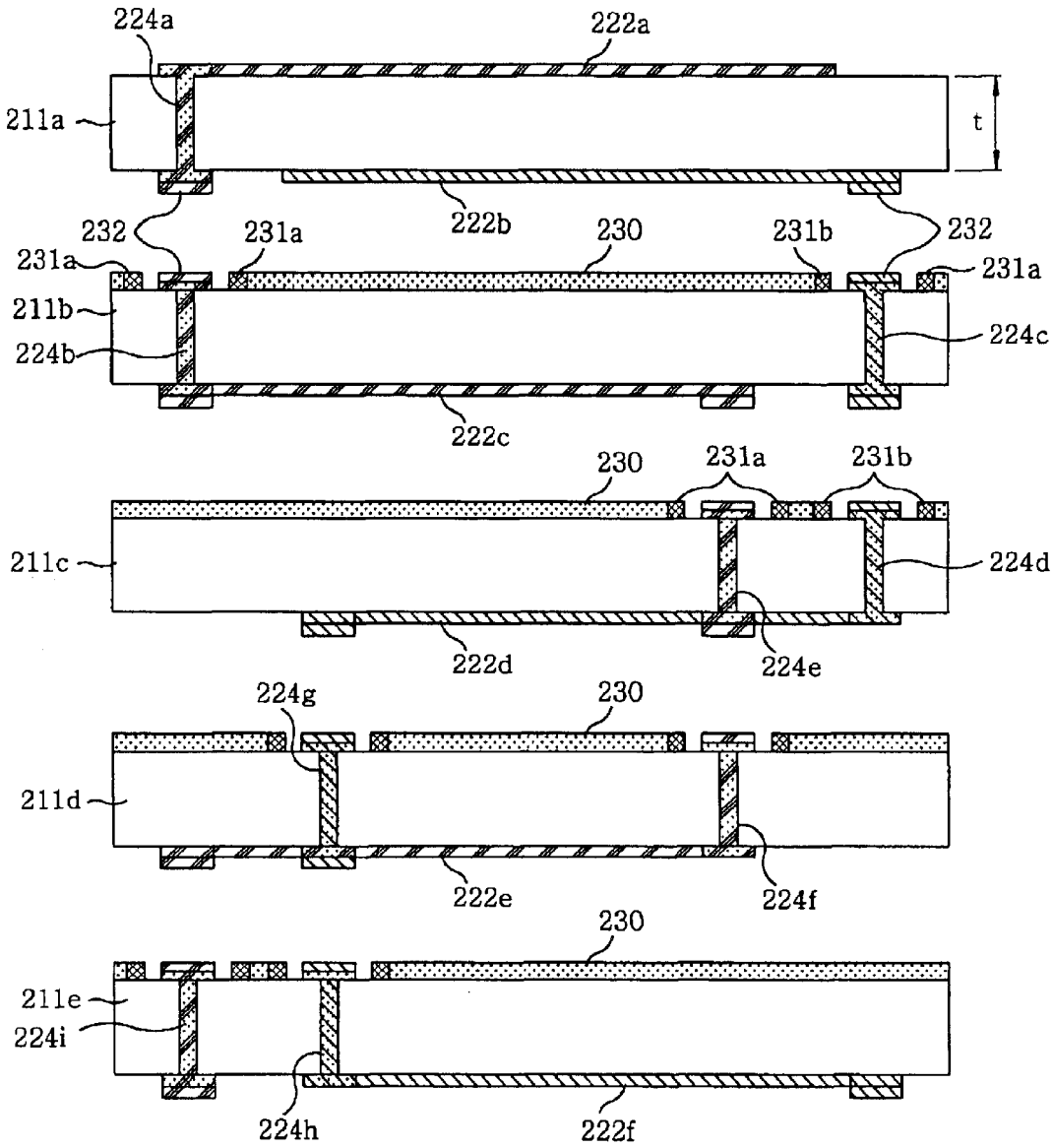
FIG. 16 is an exploded cross-sectional view of the stacked structure of the multi-band helical antenna in accordance with the third embodiment.
Figure 17A:
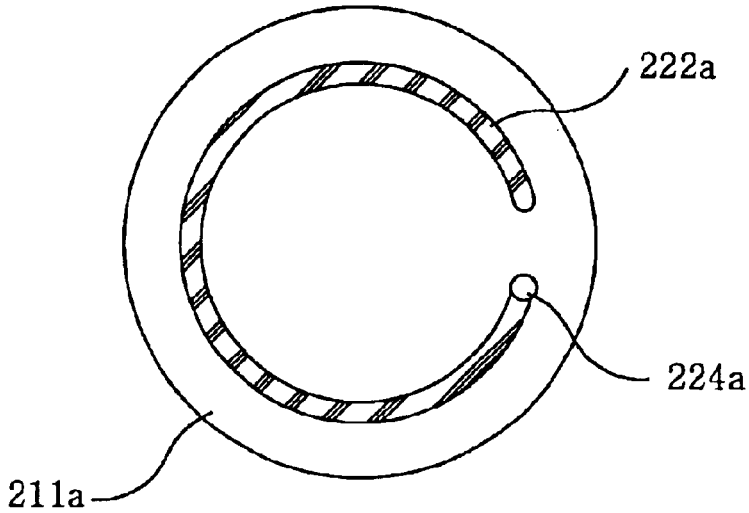
FIGS. 17A and 17B are a top and a bottom views of the uppermost layer of dielectric sheet in accordance with the third embodiment, respectively.
Figure 17B:
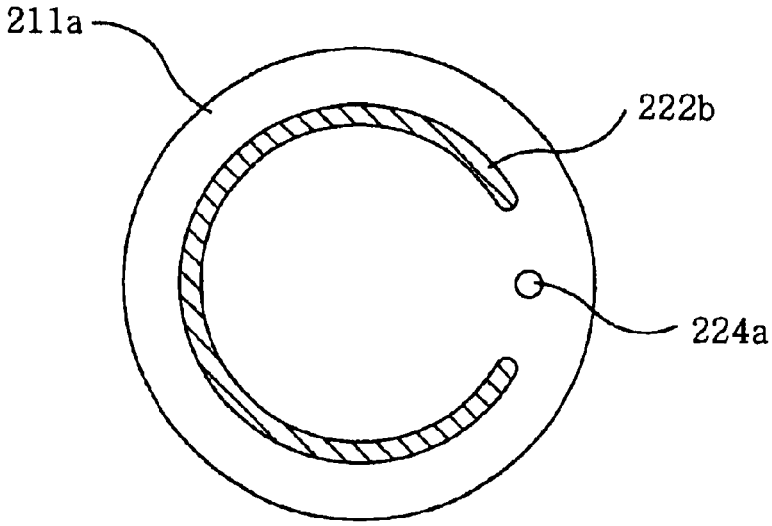
Figure 18A:
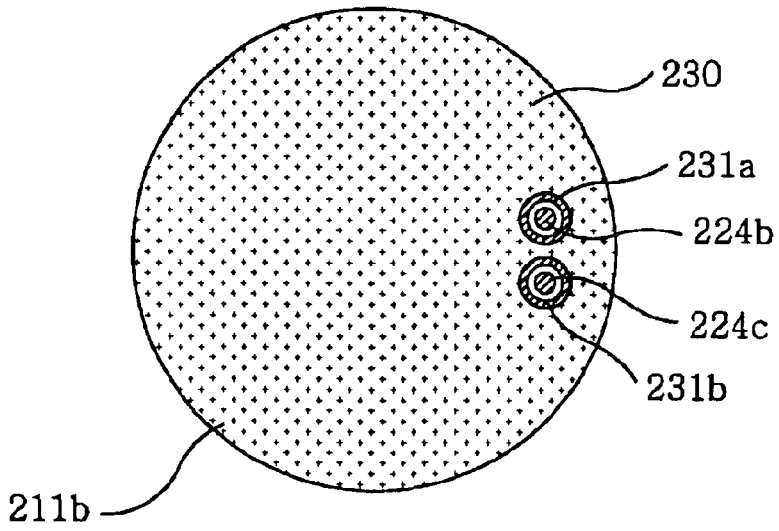
FIGS. 18A and 18B are a top and a bottom views of the second layer of dielectric sheet, respectively.
Figure 18B:
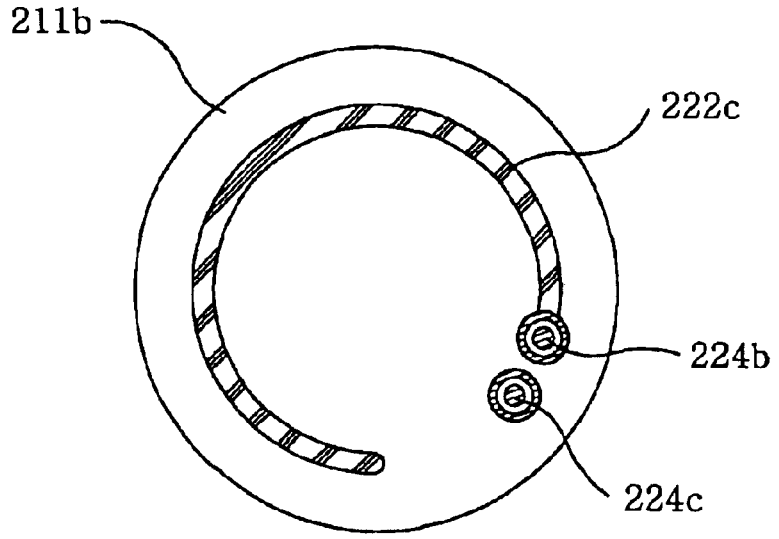
Figure 19A:
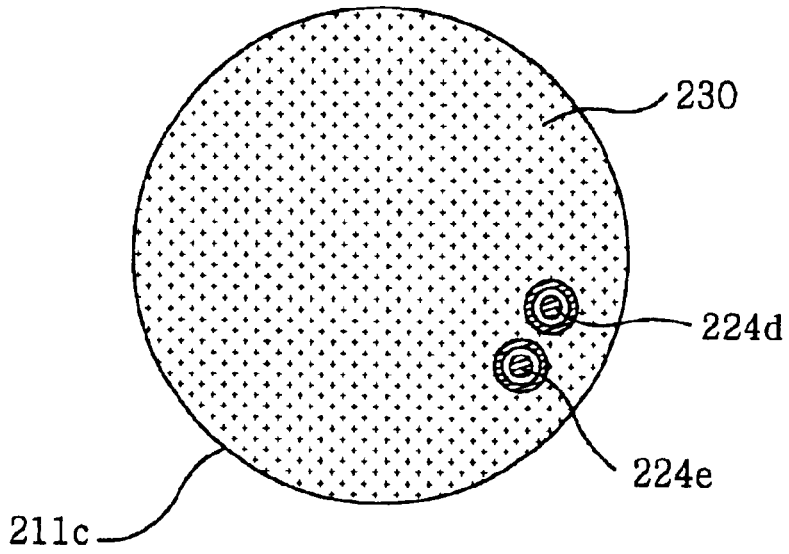
FIGS. 19A and 19B are a top and a bottom views of the third layer of dielectric sheet, respectively.
Figure 19B:
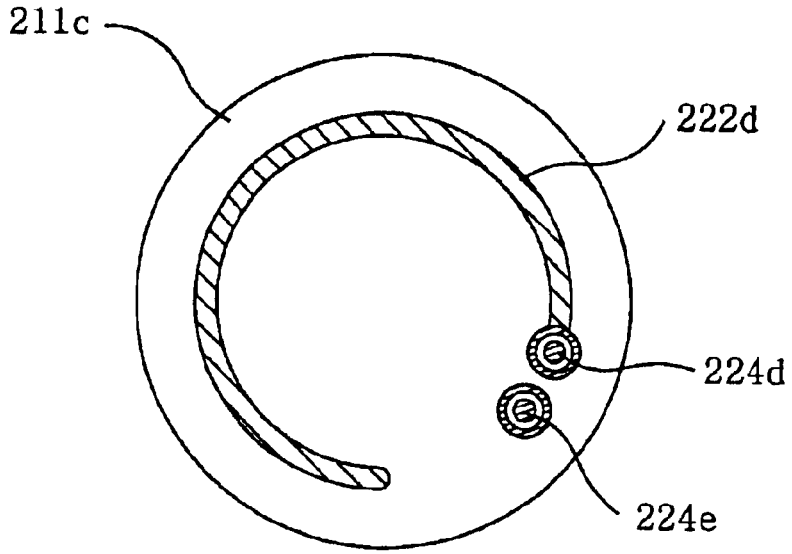

In a variation of the third embodiment as shown in FIG. 13B, while the turns in the first and the second metallic pattern sections 220, 221 are the same, the entire lengths thereof are slightly different from each other. FIG. 15 is a graph showing a resonant characteristic in a wide band according to the variation of the present invention. Specifically, the resonant frequency is determined by the resonant length of the first metallic pattern section 220, and the resonance of the second metallic pattern section 221 is generated at a frequency near the resonant frequency of the first metallic pattern section 220. The helical antenna has two adjacent resonant frequency characteristics and exhibits a wider resonant characteristic than in a single metallic pattern section.

In the above embodiment, for simplification of explanation, two metallic pattern sections having different entire lengths are shown; but the present invention is not limited thereto. It is appreciated that the helical antenna may have a multiple resonant characteristic by employing three or more pattern sections having different entire lengths.

Referring to FIGS. 16 to 19B, the stacking process of the helical antenna in accordance with the third embodiment of the present invention will now be described.

The plurality of dielectric sheets 211 of a predetermined thickness t is prepared. The partially opened circular loop patterns 222 of a predetermined diameter are formed on the bottom surfaces of the dielectric sheets 211, respectively.

The uppermost dielectric sheet 211*a* has a via hole 224*a* extending therethrough, the via hole 224*a* being disposed within the open angle of the loop pattern 222*b* formed on the bottom surface thereof. The uppermost dielectric sheet 211*a* has on the top surface thereof the partially opened circular loop pattern 222*a* which is electrically connected with the connection element filled in the via hole 224*a*. The uppermost dielectric sheet 211*a* also has on the bottom surface thereof the partially opened circular loop pattern 222*b* which is connected with the connection element filled in the via hole 224*b*. Each of the remaining dielectric sheets 211*b*, 211*c*, 211*d* and so on has on the bottom surface thereof the partially opened circular loop patterns 222*c*, 222*d*, 222*e* and so on.

The dielectric sheet 211*b* underlying the uppermost 211*a* has a via hole 224*b* at the starting end of the loop pattern 222*a* formed on the bottom surface thereof, the via hole 224*b* being registered with the via hole 224*a* and extending through the dielectric sheet 211*b*. A via hole 224*c* is also formed in the dielectric sheet 211*b* within the opening angle of the loop pattern 222*c*.

Further, the dielectric sheet 211*c* underlying the dielectric sheet 211*b* has a via hole 224*d* at the starting end of the loop pattern 222*d* formed on the bottom surface thereof, the via hole 224*d* being registered with the via hole 224*b* and extending through the dielectric sheet 211*c*. A via hole 224*e* is also formed in the dielectric sheet 211*c* within the opening angle of the loop pattern 222*d*.

Such via holes 224*a* to 224*e* extend through the corresponding dielectric sheets 211, and a conductive metallic material same as that of the loop patterns 222 is filled in the via holes 224*a* to 224*e* to form the first and the second connection elements 223*a*, 223*b*.

Specifically, the loop pattern 222*b* formed on the top surface of the dielectric sheet 211*a* is connected through the connection element filled in the via holes 224*a*, 224*b* to the loop pattern 222*c* formed on the bottom surface of the dielectric sheet 211*b* to form the first metallic pattern section 220. Further, the loop pattern 222*a* formed on the bottom surface of the dielectric sheet 211*a* is connected through the connection element filled in the via holes 224*c*, 224*d* to the loop pattern 222*d* formed on the bottom surface of the dielectric sheets 211*c* to form the second metallic pattern section 221.

In other words, the odd numbered loop patterns 222*b*, 222*c* and 222*e* are sequentially connected by the first connection elements 223*a* filled in the via holes 224*a*, 224*b*, 224*e*, 224*f* and 224*i* to form the first metallic pattern section 220; and the even numbered loop patterns 22*a*, 222*d* and 222*f* are sequentially connected by the second connection elements 223*b* filled in the via holes 224*c*, 224*d*, 224*g* and 224*h* to form the second metallic pattern section 221.

With the exception of the uppermost dielectric sheet 211*a*, an adhesive layer 230 is applied on the top surfaces of the dielectric sheets 211 for the stack thereof. The adhesive layer 230 disposed on the electrical contact portion of the connection element 223 is removed by, e.g., masking. Preferably, a barrier 231 is disposed around the connection element 223 for preventing the adhesive material from contacting the connection element 223. Preferably, the barrier 231 has a circular shape and a thickness of about 0.5~1.5 mm to shield the connection element 223.

One dielectric sheet 211 is stacked on the top surface of another dielectric sheet 211 on which the adhesive layer 230 is applied.

Preferably, contact materials 232*a*, 232*b* are coated on one or both of the contact portions of the connection element 223 and the loop pattern in order to facilitate the electrical connection therebetween. The contact materials 232*a*, 232*b* may be a good conductive metal such as copper, silver and gold.

The partially opened loop pattern 222*b* formed on the top surface of the uppermost dielectric sheet 11*b* is maintained opened. The starting portion of the partially opened loop pattern 222 formed on the bottom surface of the lowermost dielectric sheet 211 is electrically connected to the line 42 for supplying an electric power to the antenna and connected to the matching circuit 43 for matching the antenna. (see FIG. 6)

In this embodiment, for simplification of explanation, two metallic pattern sections having different entire lengths are shown, but the present invention is not limited thereto. It is appreciated that the helical antenna may have a multiple resonant characteristic by employing three or mote pattern section having different entire lengths.

While the invention has been shown and described with respect to the preferred embodiments, it will be understood by those skilled in the art that various changes and modifications may be made without departing from the spirit and scope of the invention as defined in the following claims.

What is claimed is:

1. A multi-band helical antenna comprising:

a dielectric body including a plurality of dielectric sheets stacked in a predetermined order; and at least a first metallic pattern section and a second metallic pattern section provided in the dielectric body, the first metallic pattern section including a plurality of first partially opened metallic loop patterns and a plurality of first connection elements connecting the respective adjacent first partially opened metallic loop patterns to form a first spiral structure, and the second metallic pattern section including a plurality of second partially opened metallic loop patterns and a plurality of second connection elements connecting the respective adjacent second partially opened metallic loop patterns to form a second spiral structure, the first and the second metallic pattern sections having different entire lengths.

2. The antenna of claim 1, wherein the dielectric body has a rectangular parallelepiped shape.

3. The antenna of claim 1, wherein each of the dielectric sheets has a via hole and the connection element is provided by filling a conductive material same as that of the metallic loop patterns in the via hole.

4. The antenna of claim 1, wherein an adhesive layer is provided between the adjacent dielectric sheets.

5. The antenna of claim 4, wherein a barrier is provided on the dielectric sheet around each of the connection elements to prevent the adhesive from contacting the connection elements.

6. A multi-band helical antenna comprising:

a dielectric body including at least a plurality of first dielectric sheets of a first thickness tl and a plurality of second dielectric sheets of a second thickness t2 that is different from t1, the dielectric sheets being stacked in a predetermined order; and at least a first metallic pattern section and a second metallic pattern section provided in the first dielectric sheets and the second dielectric sheets, respectively, the first metallic pattern section including a plurality of first partially opened metallic loop patterns spaced apart from each other by a first distance and a plurality of first connection elements connecting the respective adjacent first metallic loop patterns to form a first spiral structure, and the second metallic pattern section including a plurality of second partially opened metallic loop patterns spaced apart from each other by a second distance different from the first distance and a plurality of second connection elements connecting the respective adjacent second metallic loop patterns to form a second spiral structure.

7. The antenna of claim 6, wherein the dielectric body has a rectangular parallelepiped shape.

8. The antenna of claim 6, wherein each of the dielectric sheets has a via hole and the connection element is provided by filling a conductive material same as that of the metallic loop patterns in the via hole.

9. The antenna of claim 6, wherein an adhesive layer is provided between the adjacent dielectric sheets.

10. A multi-band helical antenna comprising:

a dielectric body including a plurality of dielectric sheets of a predetermined thickness, the dielectric sheets being stacked in a predetermined order; and at least a first metallic pattern section and a second metallic pattern section provided in the dielectric body, the first metallic pattern section including a plurality of first partially opened metallic loop patterns having a first radius r1 and a plurality of first connection elements connecting the respective adjacent first partially opened metallic loop patterns to form a first spiral structure, and the second metallic pattern section including a plurality of second partially opened metallic loop patterns having a second radius r2 that is different from r1 and a plurality of second connection elements connecting the respective adjacent second partially opened metallic loop patterns to form a second spiral structure.

11. The antenna of claim 10, wherein the dielectric body has a rectangular parallelepiped shape.

12. The antenna of claim 10, wherein each of the dielectric sheets has a via hole and the connection element is provided by filling a conductive material same as that of the metallic loop patterns in the via hole.

13. The antenna of claim 10, wherein an adhesive layer is provided between the adjacent dielectric sheets.

14. A multi-band helical antenna comprising:

a dielectric body including a plurality of dielectric sheets of a predetermined thickness, the dielectric sheets being stacked in a predetermined order;

at least a first metallic pattern section and a second metallic pattern section provided in the dielectric body, the first metallic pattern section including a plurality of first partially opened metallic loop patterns having a first entire length l1 and a plurality of first connection elements connecting the respective adjacent first partially opened metallic loop patterns to form a first spiral structure, and the second metallic pattern section including a plurality of second partially opened metallic loop patterns having a second entire length l2 different from l1 and a plurality of second connection elements connecting the respective adjacent second partially opened metallic loop patterns to form a second spiral structure.

15. The antenna of claim 14, wherein the first and the second metallic loop patterns are alternately disposed in a vertical direction.

16. The antenna of claim 4, wherein the dielectric body has a rectangular parallelepiped shape.

17. The antenna of claim 14, wherein each of the dielectric sheets has a via hole and the connection element is provided by filling a conductive material same as that of the metallic loop patterns in the via hole.

18. The antenna of claim 14, wherein an adhesive layer is provided between the adjacent dielectric sheets.

* * * * *